US008367954B2

(12) United States Patent
Mao et al.

(10) Patent No.: US 8,367,954 B2
(45) Date of Patent: Feb. 5, 2013

(54) BUTTON STRUCTURE WITH LIGHT TRANSMITTANCE AND RELATED ELECTRONIC DEVICE

(75) Inventors: Zhong-hui Mao, Taipei Hsien (TW); Chia-Hsin Hsieh, Taipei Hsien (TW)

(73) Assignee: Wistron Corporation, Xizhi Dist., New Taipei (TW)

( * ) Notice: Subject to any disclaimer, the term of this patent is extended or adjusted under 35 U.S.C. 154(b) by 319 days.

(21) Appl. No.: 12/860,944

(22) Filed: Aug. 23, 2010

(65) Prior Publication Data

US 2011/0067989 A1 Mar. 24, 2011

(30) Foreign Application Priority Data

Sep. 21, 2009 (TW) ..... 98131750 A

(51) Int. Cl.
*H01H 9/00* (2006.01)

(52) U.S. Cl. ..... 200/314

(58) Field of Classification Search ..... 200/310–314
See application file for complete search history.

(56) References Cited

U.S. PATENT DOCUMENTS

| | | | | |
|---|---|---|---|---|
| 3,467,802 | A * | 9/1969 | Martin | 200/314 |
| 3,988,557 | A * | 10/1976 | Francke et al. | 200/314 |
| 4,354,077 | A * | 10/1982 | McMains et al. | 200/314 |
| 4,496,813 | A * | 1/1985 | Fukushima | 200/314 |
| 4,749,832 | A * | 6/1988 | Schlosser | 200/314 |
| 6,160,232 | A * | 12/2000 | Lin | 200/341 |
| 6,180,905 | B1 * | 1/2001 | Pollock et al. | 200/527 |
| 7,105,760 | B2 * | 9/2006 | Zensai | 200/341 |
| 7,635,820 | B2 * | 12/2009 | Shen et al. | 200/314 |
| 7,692,111 | B1 * | 4/2010 | Rosing et al. | 200/310 |
| 2003/0226745 | A1 * | 12/2003 | Sato et al. | 200/5 R |
| 2008/0128250 | A1 * | 6/2008 | Shen et al. | 200/314 |
| 2011/0036693 | A1 * | 2/2011 | Lin et al. | 200/314 |

FOREIGN PATENT DOCUMENTS

| | | | |
|---|---|---|---|
| CN | 101471193 | A | 7/2009 |
| EP | 0593804 | A1 | 4/1994 |
| TW | M294733 | | 7/2006 |
| TW | 200701281 | | 1/2007 |
| TW | 200845070 | | 11/2008 |
| TW | M364232 | | 9/2009 |

OTHER PUBLICATIONS

Office action mailed on Apr. 5, 2012 for the Taiwan application No. 098131750, p. 2 line 5~26 and p. 3, p. 4 line 1~5, p. 6 line 13~19.
Office action mailed on Aug. 31, 2012 for the China application No. 200910177243.1, p. 3 line 5-16.

* cited by examiner

*Primary Examiner* — Briggitte R Hammond
(74) *Attorney, Agent, or Firm* — Winston Hsu; Scott Margo

(57) ABSTRACT

A button structure includes a pressing portion, and an accommodating portion connected to a side of the pressing portion. An accommodating space is formed inside the accommodating portion. The button structure further includes a protruding portion connected to a side of the accommodated portion for actuating a switch when the pressing portion is pressed, and a light guiding portion. An end of the light guiding portion is disposed above a light source, and the other end of the light guiding portion is disposed inside the accommodating space. The light guiding portion is for guiding light emitted from the light source to project on a bottom of the pressing portion.

20 Claims, 5 Drawing Sheets

BUTTON STRUCTURE WITH LIGHT TRANSMITTANCE AND RELATED ELECTRONIC DEVICE

BACKGROUND OF THE INVENTION

1. Field of the Invention

The present invention relates to a button structure and a related electronic device, and more particularly, to a button structure with light transmittance and a related electronic device.

2. Description of the Prior Art

For visual aesthetics, an electronic device includes a conventional button structure with light transmittance so as to display different projecting images in different operating states. For example, a power button of a notebook computer does not display color when the notebook computer is shut down. When an electrical cable is electrically connected to a power source to transmit electricity to the notebook computer, the power button can display red light so as to represent information that the power is connected but the computer is not powered on. When the electrical cable is electrically connected to the power source and the notebook computer is powered on, the power button can display green light so as to represent information that the power source is connected and the computer is powered on.

However, the conventional button structure with light transmittance includes a pressing portion disposed above a switch on a base, so that the pressing portion is pressed for actuating the switch to output a control signal. Therefore, a light guiding component for guiding light emitted from a light source to project on the pressing portion can not be disposed right beneath the pressing portion. For example, the light guiding component is disposed on a lateral side of a rod connected with the pressing portion for actuating the switch. Because the light guiding component and the light source are not disposed right beneath the pressing portion, the light guiding component can not guide the light emitted from the light source to project on the pressing portion uniformly, which means a projecting image on the pressing portion includes a shadow of the rod. Thus, design a button structure with uniform light transmittance is an important issue in the button structural design.

SUMMARY OF THE INVENTION

The present invention provides a button structure with light transmittance and a related electronic device for solving above drawbacks.

According to the claimed invention, a button structure includes a pressing portion, an accommodating portion connected to a side of the pressing portion, an accommodating space being formed inside the accommodating portion, a protruding portion connected to a side of the accommodated portion for actuating a switch when the pressing portion is pressed, and a light guiding component, an end of the light guiding component being disposed above a light source and the other end of the light guiding component being disposed inside the accommodating space, the light guiding component being for guiding light emitted from the light source to project on a bottom of the pressing portion.

According to the claimed invention, the light guiding component includes a plurality of light guiding units for guiding light emitted from a plurality of light emitters to project on the bottom of the pressing portion or a surface of a panel, so as to project different images to represent different operating states.

According to the claimed invention, the light guiding component includes a plurality of light guiding units, and one of the light guiding units is for guiding the light emitted from the light source to project on the bottom of at least one pressing portion.

According to the claimed invention, a distance between a top surface of the light guiding component and a top surface of the accommodating space is greater than maximum movement of the pressing portion so that the light guiding component does not contact the pressing portion when the pressing portion is pressed.

According to the claimed invention, an electronic device includes a panel, a switch disposed on a base, a light source disposed on the base, and a button structure installed on the panel for actuating the switch. The button structure includes a pressing portion, an accommodating portion connected to a side of the pressing portion, an accommodating space being formed inside the accommodating portion, a protruding portion connected to a side of the accommodating portion for actuating the switch when the pressing portion is pressed, and a light guiding component, an end of the light guiding component being disposed above the light source and the other end of the light guiding component being disposed inside the accommodating space, the light guiding component being for guiding light emitted from the light source to project on a bottom of the pressing portion.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
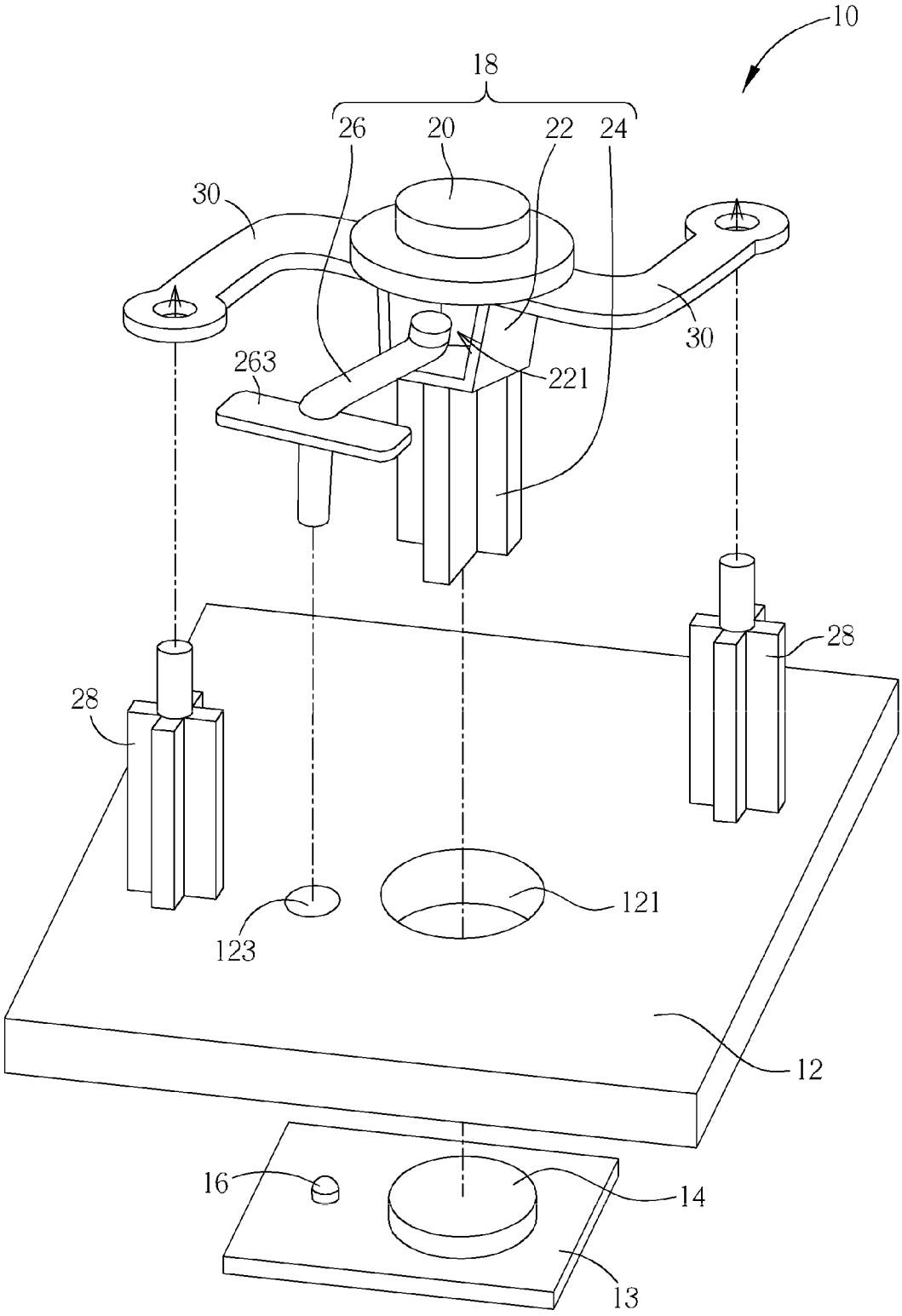
FIG. 1 is an exploded diagram of components of an electronic device according to a preferred embodiment of the present invention.

Please refer to FIG. 1. FIG. 1 is an exploded diagram of components of an electronic device 10 according to a preferred embodiment of the present invention. The electronic device 10 includes a panel 12, a switch 14 disposed on a base 13, a light source 16 disposed on the base 13, and a button structure 18 installed on the panel 12 for actuating the switch 14. The base 13 can be a printed circuit board. The button structure 18 includes a pressing portion 20, and an accommodating portion 22 connected to a side of the pressing portion 20. An accommodating space 221 is formed inside the accommodating portion 22. The button structure 18 further includes a protruding portion 24 connected to a side of the accommodating portion 22, and a light guiding component 26. An end of the light guiding component 26 is disposed above the light source 16, and the other end of the light guiding component 26 is disposed inside the accommodating space 221. In addition, the light guiding component 26 can include a carrier 263 for fixing a position of the light guiding component 26. The pressing portion 20, the accommodating portion 22, and the protruding portion 24 can be integrated monolithically. When the electronic device 10 is powered on, the protruding portion 24 is for actuating the switch 14 when the pressing portion 20 is pressed, and then the switch 14 outputs a control signal to power on the light source 16. Meanwhile, the light guiding component 26 is for guiding light emitted from the light source 16 to project on a bottom of the pressing portion 20. However, After the electronic device 10 is powered on, operation of the light source 16 depends on a setting of the electronic device 10, which means the operation of the light source 16 is not limited to whether the switch 14 is actuated or not. For example, if the button structure 18 is utilized to be an indicator after the electronic device 10 is powered on, the light source 16 emits the light continuously after the switch 14 is actuated. Furthermore, a distance between a top surface of the light guiding component 26 and a top surface of the accommodating space 221 of the accommodating portion 22 is greater than maximum movement of the pressing portion 20, so that the light guiding component 26 does not contact the pressing portion 20 and the accommodating portion 22 when the pressing portion 20 is pressed.

A first hole 121 is formed on the panel 12, and the switch 14 is disposed on a side of the first hole 121. The protruding portion 24 can pass through the first hole 121 and actuate the switch 14 disposed on the base 13 when the user presses the pressing portion 20, and the switch 14 outputs the corresponding control signal when being actuated. A second hole 123 is formed on the panel 12. The light guiding component 26 passes through the second hole 123 so as to guide the light emitted from the light source 16 disposed on the base 13. In addition, the button structure 18 further includes two supporting components 28 disposed on the panel 12, respectively. The button structure 18 further includes two fixing components 30. Two ends of the fixing components 30 are respectively connected to the pressing portion 20, and the other two ends of the fixing components 30 are respectively connected to the two supporting components 28 so as to fix the pressing portion 20 on the supporting components 28. Positions and numbers of the fixing components 30 and the supporting components 28 are not limited to the above-mentioned embodiment and depend on actual demand.

The light guiding component 26 guides the light by internal total reflection, and the light guiding component 26 are made of reflective material. For example, the light guiding component 26 can be made of acrylic material or polycarbonate material. The light source 16 can be a light emitting diode. Because the pressing portion 20 is made of transmissible material and a pattern can be formed on the pressing portion 20, the light guiding component 26 can guide the light emitted from the light source 16 to project on a side of the pressing portion 20, so that the other side of the pressing portion 20 displays a projecting image corresponding to the pattern.

Figure 2:
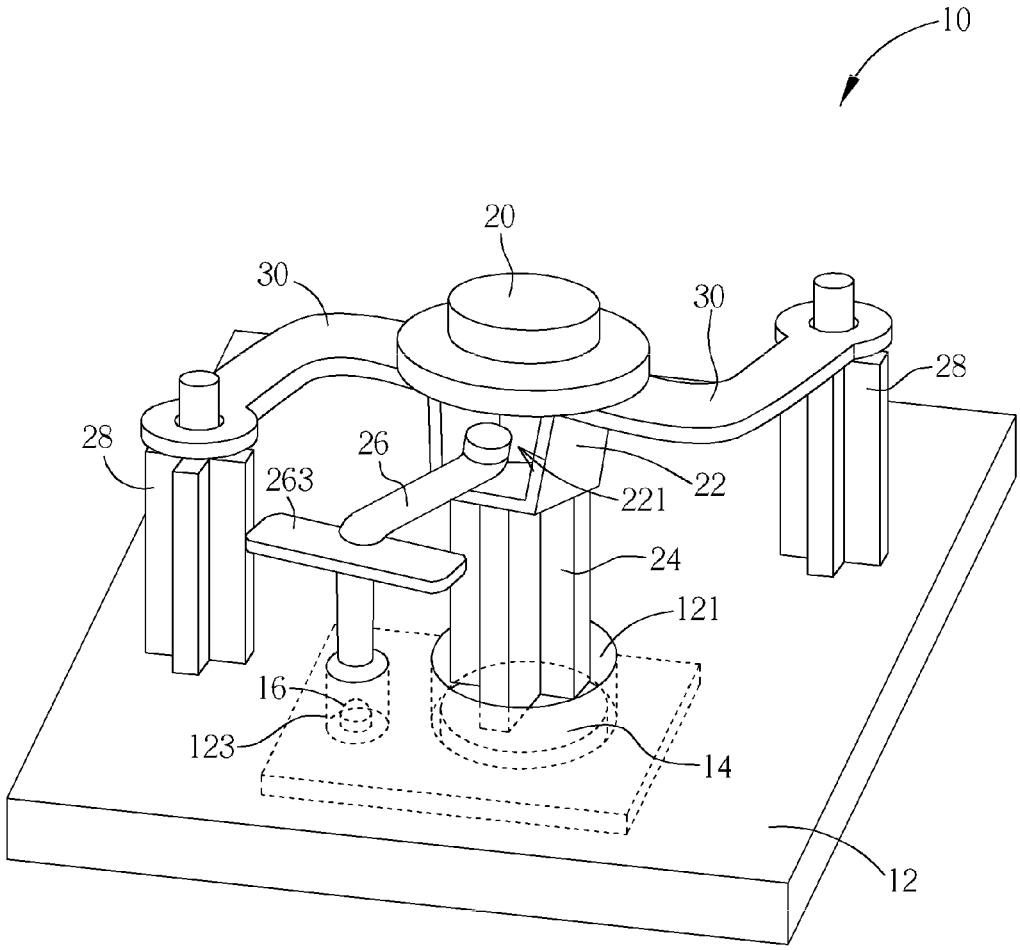
FIG. 2 is a diagram showing motion of a button structure according the preferred embodiment of the present invention.

Please refer to FIG. 2. FIG. 2 is a diagram showing motion of the button structure 18 according the preferred embodiment of the present invention. When the pressing portion 20 is not pressed, the end of each fixing component 30 is connected to the pressing portion 20, and the other end of the fixing component 30 is disposed on the supporting component 28 so as to hold the pressing portion 20 at an initial position. When the pressing portion 20 is pressed and moves downward, the fixing components 30 are deformed and the protruding portion 24 connected to the side of the pressing portion 20 can move in a predetermined track for actuating the switch 14, and the switch 14 can output the corresponding control signal after being actuated. After the pressed pressing portion 24 is released, the pressing portion 20 and the fixing components 30 are recovered to the initial position due to elastic restoring force of the fixing components 30. Therefore, the accommodating portion 22 moves downward and upward according to a pressing route and a releasing route of the pressing portion 20, respectively. A distance between the top surface of the light guiding component 26 and the top surface of the accommodating space 221 of the accommodating portion 22 is greater than the maximum movement of the pressing portion 20, so that the end of the light guiding component 26 disposed inside the accommodating space 221 does not contact the pressing portion 20 and the accommodating portion 22 when the pressing portion 20 is pressed. Position of the light guiding component 26 inside the accommodating space 221 is not limited to the position shown in FIG. 2 and depends on design demand.

Figure 3:
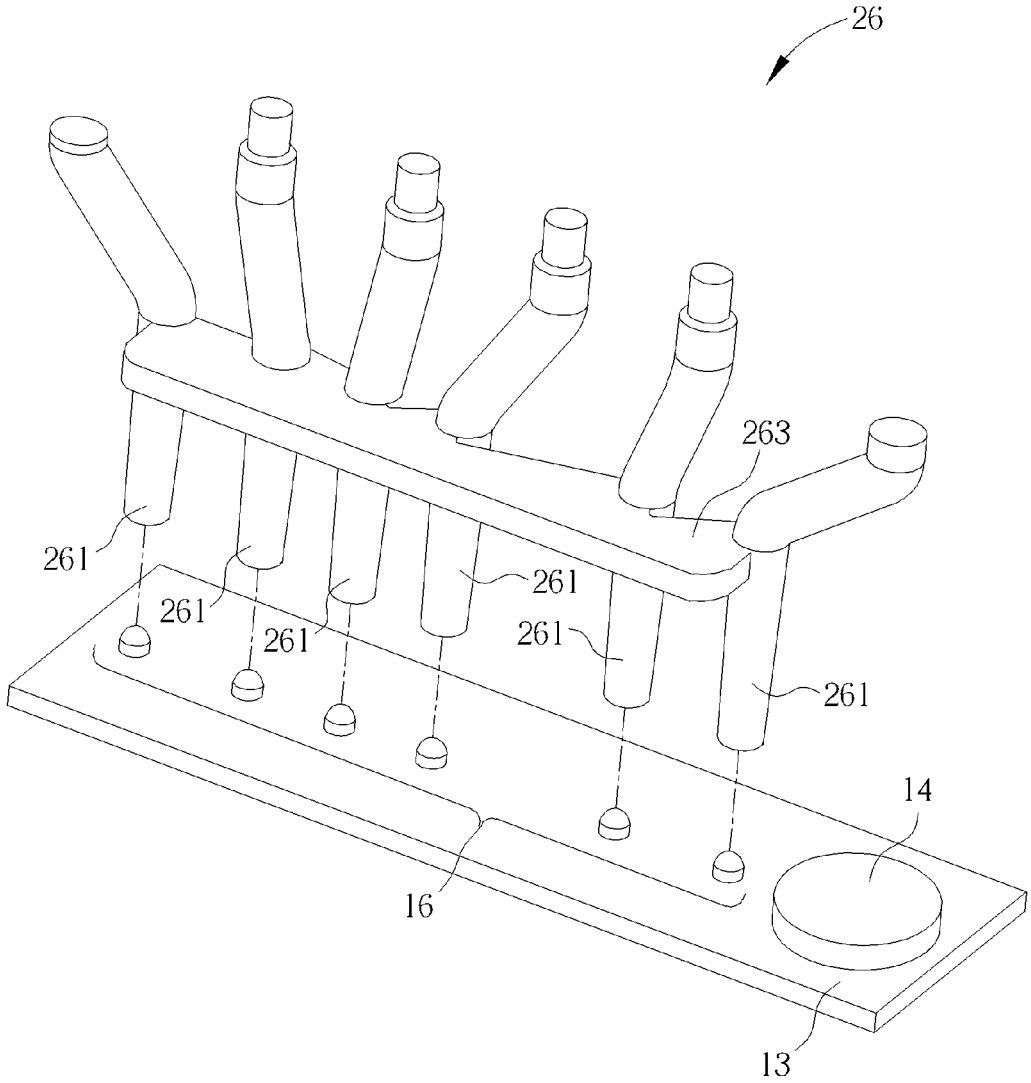
FIG. 3 is a diagram of a light guiding component according to another embodiment of the present invention.

Please refer to FIG. 3. FIG. 3 is a diagram of the light guiding component 26 according to another embodiment of the present invention. The light source 16 can include a plurality of light emitters capable of emitting different colors. For example, the light emitter can be a blue ray LED, a red ray LED, a yellow ray LED, and so on. The light guiding component 26 can include a plurality of light guiding units 261. One of the light guiding units 261 can guide light emitted from one of the plurality of light emitters to project on the top surface of the accommodating space 221 of the accommodating portion 22, so as to display the projecting images with different colors for representing different operating states on the side of the pressing portion 20. For example, the projecting image can be a white image, a green image, a purple image, and so on. In addition, the light guiding component 26 can further include the carrier 263 for carrying the plurality of light guiding units 261. The whole light guiding component 26 can be made of transparent material, such as the acrylic material, the polycarbonate material, and so on. The carrier 263 can be integrated with the light guiding unit 261 monolithically.

Figure 4:
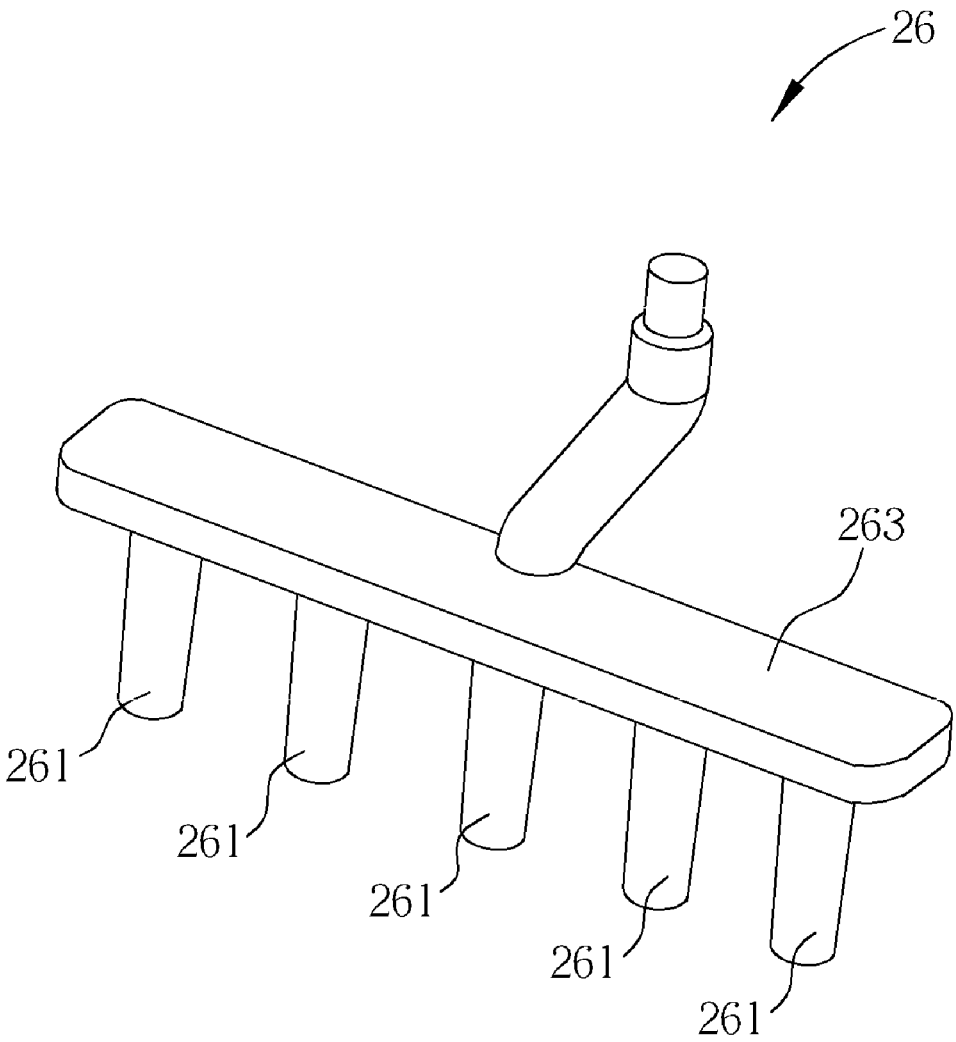
FIG. 4 is a diagram of a light guiding component according to another embodiment of the present invention.

Please refer to FIG. 4. FIG. 4 is a diagram of the light guiding component 26 according to another embodiment of the present invention. The light source 16 can further include the plurality of light emitters capable of emitting different colors. For example, the light emitter can be a blue ray LED, a red ray LED, a yellow ray LED, and so on. The light guiding component 26 can include the plurality of light guiding units 261 for guiding the light emitted from the plurality of light emitters to project on the side of the pressing portion 20 respectively, so as to mix the different colors. That is to say, if the light source 16 includes three light emitters, such as the blue ray LED, the red ray LED, and the yellow ray LED, the plurality of light guiding units 261 of the light guiding component 26 can guide the intending light emitted from the three light emitters to project on the side of the pressing portion 20, so as to display the intending projecting images with different colors, such as the white image, the green image, the purple image, and so on.

Figure 5:
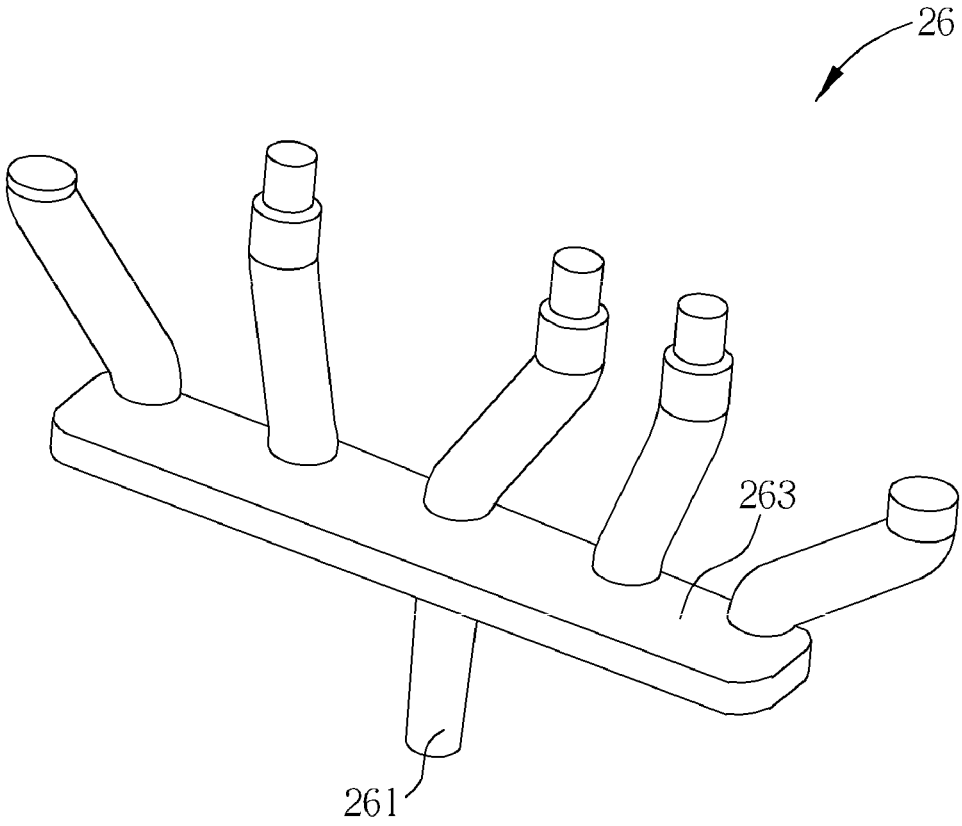
FIG. 5 is a diagram of a light guiding component according to another embodiment of the present invention.

Please refer to FIG. 5. FIG. 5 is a diagram of the light guiding component 26 according to another embodiment of the present invention. The button structure 18 can utilize the light guiding unit 261 to guide the light emitted from the light source 16 to project on a plurality of pressing portions 20, so that the light emitted from the single light source 16 can be uniformly projected on the plurality of pressing portions 20 effectively. Positions and numbers of the plurality of light emitters of the light source 16 and the plurality of light guiding units 261 of the light guiding component 26 are not limited to the above-mentioned embodiment, and a structural design capable of utilizing the light guiding unit 261 to guide the light emitted from the light emitter is within the scope of the present invention.

Comparing to the prior art, the button structure of the present invention forms the accommodating space inside the accommodating portion, so that the end of the light guiding component can insert into the accommodating space to guide the light emitted from the light source to project on the bottom of the pressing portion, so as to prevent the projecting image from shadowing due to disposition of the light guiding component on the lateral side of the protruding portion in the prior art. The button structure of the present invention can guide the light emitted from the light source to uniformly project on the side of the pressing portion effectively, so as to display the projecting image with preferred light transmittance on the other side of the pressing portion and to promote aesthetic of the projecting image on the button structure.

Those skilled in the art will readily observe that numerous modifications and alterations of the device and method may be made while retaining the teachings of the invention.

What is claimed is:

1. A button structure comprising:

a pressing portion;

an accommodating portion connected to a side of the pressing portion, an accommodating space being formed inside the accommodating portion;

a protruding portion movably disposed on a panel, the protruding portion being connected to a side of the accommodated portion for actuating a switch when the pressing portion is pressed; and a light guiding component disposed on the panel, an end of the light guiding component being disposed above a light source and the other end of the light guiding component being suspended inside the accommodating space, the light guiding component being for guiding light emitted from the light source to project on a bottom of the pressing portion.

2. The button structure of claim 1 further comprising:

a supporting component; and a fixing component connected to an end of the pressing portion for fixing the pressing portion on the supporting component.

3. The button structure of claim 1, wherein the pressing portion is made of transparent material.

4. The button structure of claim 1, wherein the light source comprises a plurality of light emitters.

5. The button structure of claim 4, wherein the light guiding component comprises a plurality of light guiding units for guiding light emitted from the plurality of light emitters to project on the bottom of the pressing portion or a surface of a panel, so as to project different images to represent different operating states.

6. The button structure of claim 4, wherein the light source comprises the plurality of light emitters for emitting light of different colors.

7. The button structure of claim 1, wherein the light guiding component comprises a plurality of light guiding units, and one of the light guiding units is for guiding the light emitted from the light source to project on the bottom of at least one pressing portion.

8. The button structure of claim 1, wherein a distance between a top surface of the light guiding component and a top surface of the accommodating space is greater than maximum movement of the pressing portion so that the light guiding component does not contact the pressing portion when the pressing portion is pressed.

9. The button structure of claim 1, wherein the light source is a light emitting diode.

10. An electronic device comprising:

a panel;

a switch disposed on a base;

a light source disposed on the base; and a button structure installed on the panel for actuating the switch, the button structure comprising:

a pressing portion;

an accommodating portion connected to a side of the pressing portion, an accommodating space being formed inside the accommodating portion;

a protruding portion movably disposed on the panel, the protruding portion being connected to a side of the accommodating portion for actuating the switch when the pressing portion is pressed; and a light guiding component disposed on the panel, an end of the light guiding component being disposed above the light source and the other end of the light guiding component being suspended inside the accommodating space, the light guiding component being for guiding light emitted from the light source to project on a bottom of the pressing portion.

11. The electronic device of claim 10, wherein the button structure further comprises a supporting component disposed on the panel.

12. The electronic device of claim 11, wherein the button structure further comprises a fixing component connected to an end of the pressing portion for fixing the pressing portion on the supporting component.

13. The electronic device of claim 10, wherein the pressing portion is made of transparent material.

14. The electronic device of claim 10, wherein the light source comprises a plurality of light emitters.

15. The electronic device of claim 14, wherein the light guiding component comprises a plurality of light guiding units for guiding light emitted from the plurality of light emitters to project on the bottom of the pressing portion or a surface of a panel, so as to project different images to represent different operating states.

16. The electronic device of claim 14, wherein the light source comprises the plurality of light emitters for emitting light of different colors.

17. The electronic device of claim 10, wherein the light guiding component comprises a plurality of light guiding units, and one of the light guiding units is for guiding the light emitted from the light source to project on the bottom of at least one pressing portion.

18. The electronic device of claim 10, wherein a distance between a top surface of the light guiding component and a top surface of the accommodated space is greater than maximum movement of the pressing portion so that the light guiding component does not contact the pressing portion when the pressing portion is pressed.

19. The electronic device of claim 10, wherein a first hole is formed on the panel for guiding the protruding portion to actuate the switch when the pressing portion is pressed.

20. The electronic device of claim 10, wherein a second hole is formed on the panel, and the light guiding component passes through the second hole to guide the light emitted from the light source.

* * * * *